US006494696B2

(12) United States Patent
Terai et al.

(10) Patent No.: US 6,494,696 B2
(45) Date of Patent: Dec. 17, 2002

(54) SCROLL COMPRESSOR

(75) Inventors: Toshiyuki Terai, Tochigi-ken (JP); Isao Hayase, Tsuchiura (JP); Masahiro Takebayashi, Tochigi-ken (JP); Isamu Tsubono, Ibaraki-ken (JP); Masaki Koyama, Ibaraki-ken (JP); Koichi Sekiguchi, Tochigi-ken (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/853,587

(22) Filed: May 14, 2001

(65) Prior Publication Data

US 2001/0026766 A1 Oct. 4, 2001

Related U.S. Application Data

(63) Continuation of application No. 09/459,863, filed on Dec. 14, 1999.

(51) Int. Cl.[7] ..... F01C 1/02

(52) U.S. Cl. ..... 418/55.6; 418/94; 418/87; 184/6.18

(58) Field of Search ..... 418/55.6, 87, 94; 184/6.18

(56) References Cited

U.S. PATENT DOCUMENTS

| | | | | |
|---|---|---|---|---|
| 4,676,075 A | | 6/1987 | Shiibayashi | |
| 4,702,682 A | | 10/1987 | Inaba et al. | |
| 4,702,683 A | * | 10/1987 | Inaba et al. | 184/6.18 |
| 4,730,997 A | | 3/1988 | Tamura et al. | |
| 4,875,840 A | * | 10/1989 | Johnson et al. | 184/6.18 |
| 4,877,381 A | * | 10/1989 | Johnson et al. | 184/6.18 |
| 5,336,060 A | * | 8/1994 | Tomell et al. | 184/6.18 |
| 5,660,539 A | | 8/1997 | Matsunaga | |

FOREIGN PATENT DOCUMENTS

| | | | | |
|---|---|---|---|---|
| JP | 58065986 | | 4/1983 | |
| JP | 58214692 | | 12/1983 | |
| JP | 59018287 | | 1/1984 | |
| JP | 59224494 | | 12/1984 | |
| JP | 59-224494 | * | 12/1984 | 418/94 |
| JP | 60101296 | | 6/1985 | |
| JP | 7317682 | | 12/1985 | |
| JP | 62142883 | | 6/1987 | |
| JP | 03237287 | | 10/1991 | |
| JP | 04054296 | | 2/1992 | |
| JP | 04143489 | | 5/1992 | |
| JP | 719187 | | 1/1995 | |
| JP | 886293 | | 4/1996 | |
| JP | 94575 | | 1/1997 | |

* cited by examiner

*Primary Examiner*—Thomas Denion
*Assistant Examiner*—Theresa Trieu
(74) *Attorney, Agent, or Firm*—Antonelli, Terry, Stout & Kraus, LLP

(57) ABSTRACT

A scroll compressor comprising: a vessel; a compressing mechanism provided within said vessel, the compressing mechanism comprising an orbiting scroll and a non-orbiting scroll each having a spiral wrap formed in a base plate and an Oldham ring for preventing the orbiting scroll from rotating around its axis; an oil reservoir provided within a vessel; a crankshaft for transmitting a power for compressing a working fluid; and a frame on which a main bearing for supporting the crankshaft is provided, wherein the crankshaft is provided with oil supply passages for communicating a vicinity of an orbiting bearing and a vicinity of the main bearing, and openings of the oil supply passages in the vicinity of the orbiting bearing and in the vicinity of the main bearing are positioned so that a pressure of an oil film in the orbiting bearing opening generated during an operation of the compressor is higher than a pressure of an oil film in the-main bearing opening generated during an operation of the compressor.

5 Claims, 8 Drawing Sheets

SCROLL COMPRESSOR

This is a continuation application of U.S. Ser. No. 09/459,863, filed Dec. 14, 1999.

BACKGROUND OF THE INVENTION

The present invention relates to a refrigerating apparatus, an air conditioner and a scroll compressor for compressing a gas such as an air, a nitrogen and the like.

Hereinafter, a description will be given, for example, of a motor-driven hermetic scroll compressor used for air conditioning and the like.

Conventionally, in scroll compressors, control is effected so as to make a pressure in a reservoir for storing a refrigerating machine oil within a vessel equal to a discharge pressure and to make a pressure in an intermediate pressure chamber constituted by an orbiting scroll and a frame equal to an intermediate pressure between a suction pressure and the discharge pressure. Further, control is effected so that pressure differences are respectively generated between the refrigerating machine oil reservoir and the intermediate pressure chamber and between the intermediate pressure chamber and an outside of a compression chamber (having a pressure equal to the suction pressure). Further, the structure is made such that a flow passage for flowing the refrigerating machine oil is provided in a crankshaft, an end of the flow passage is open to the refrigerating machine oil reservoir within the sealed vessel, another end thereof is open to an upper portion of an orbiting bearing, the refrigerating machine oil is flowed from the upper portion of the orbiting bearing to a lower portion, and then the refrigerating machine oil is flowed to the intermediate pressure chamber, whereby a lubrication is performed.

Further, it is structured such that within the intermediate pressure chamber, after a part of the refrigerating machine oil lubricates a sliding portion of an Oldham ring, it lubricates a sliding surface between a non-orbiting scroll and an orbiting scroll from an outer peripheral portion of a base plate of the orbiting scroll and flows into a suction pressure area of the compression chamber having a pressure lower than the intermediate pressure.

In order to lubricate bearings (a main bearing and an orbiting bearing) during a compressing operation, it is important to supply the refrigerating machine oil having a lubricating function. When the refrigerating machine oil is supplied to the bearing, an oil pressure is generated due to a wedge effect, and the bearing floats up from a crankshaft, thereby providing a lubricating aspect so called as a fluid lubrication. Further, in correspondence to an operating condition, a load applied to the bearing is increased and an oil film is made thin, so that the bearing and a rotary shaft are likely brought into contact with each other, thereby providing a lubricating aspect so called as a boundary lubrication.

When the lubricating state is changed from the fluid lubrication to the boundary lubrication, a coefficient of friction is widely increased, so that a frictional heat is generated between the bearing and the crankshaft. Accordingly, a viscosity of the refrigerating machine oil is lowered and the oil film is harder to be formed, so that a reliability of the bearing is significantly reduced. In order to secure a lubricating performance of the bearing, it is necessary not only to supply the refrigerating machine oil necessary for forming the wedge-shaped oil film but also to supply an oil amount necessary for removing a heat generated in the bearing by means of the refrigerating machine oil.

On the other hand, in view of a pressure distribution within the scroll compressor, since the outside of the compression chamber is a low pressure area, it is obvious that an oil and a gas in the other higher pressure areas easily flow thereinto.

Accordingly, all amount of the refrigerating machine oil supplied to the orbiting bearing flows into the compression chamber via the intermediate pressure chamber, however, it lubricates the Oldham ring in the intermediate pressure chamber, lubricates the sliding surface between the orbiting scroll and the non-orbiting scroll, and improves a sealing performance of the compression chamber.

On the contrary, in the case that an amount of the lubricating oil is excessive, when a side surface of a wrap of the orbiting scroll and a side surface of a wrap of the non-orbiting scroll move close to each other during an operation, the refrigerating machine oil at an amount more than a clearance set between the both surfaces exists, so that a power for displacing the refrigerating machine oil is required in a compressing process, whereby an input of the compressor is increased.

In a refrigerating cycle, a refrigerant is dissolved in the refrigerating machine oil supplied to the compression chamber. When the refrigerating machine oil is agitated in the intermediate pressure chamber by a balance weight, a refrigerant gas is discharged from the refrigerating machine oil. Therefore, the pressure of the intermediate pressure chamber is controlled to be higher than the suction pressure and lower than the discharge pressure, thereby releasing the refrigerant gas to a side of the compression chamber having a lower suction pressure.

Further, the refrigerant gas is also discharged from the refrigerating machine oil flowing into the compression chamber, the refrigerant gas is discharged from the compression chamber into the vessel so as to be again dissolved in the refrigerant machine oil, and is again sucked from the intermediate pressure chamber. That is, since the refrigerant is circulated within the compressor so as to be joined with the refrigerant gas sucked from the suction pipe and an amount of the refrigerant gas at which the compression chamber can suck from the suction pipe is reduced, a circulating amount of the refrigerant in the refrigerating cycle is reduced.

Further, the refrigerating machine oil is discharged from the compression chamber together with the refrigerant gas and discharged from the compressor in a mist state. As a result, the refrigerating machine oil attaches to an inner wall of an outdoor or an indoor heat exchanger, thereby reducing a heat transmitting performance thereof. Particularly, in the case that the heat exchanger is an evaporator, much time is required until the refrigerant in the refrigerating machine oil is completely discharged, an evaporating amount of the refrigerant which is liquefied in the refrigerating cycle is reduced, and a reduction of a refrigerating capacity is caused.

Further, a balance weight rotates within the intermediate pressure chamber, so that when the refrigerating machine oil is filled, a resistance due to agitating is increased and an electric power is increased.

In comparison with an oil amount necessary for lubricating the bearing and securing a reliability at a high load, an oil amount necessary for lubricating and sealing the compression chamber is widely a little, and generally, the oil amount is determined in preferential of the lubrication of the bearing and the reliability at the high load, however, a reliability and an electric power save are in a mutually opposed relation.

An object of the present invention is to provide a scroll compressor which can limit a flowing amount of a lubricating oil to a compression chamber even when supplying a lot of lubricating oil to a bearing so as to restrict a reduction of performance due to an excessive inlet flow and can well lubricate the bearing.

SUMMARY OF THE INVENTION

The object mentioned above can be achieved by a scroll compressor comprising: a vessel; a compressing mechanism provided within said vessel, the compressing mechanism comprising an orbiting scroll and a non-orbiting scroll each having a spiral wrap formed in a base plate and an Oldham ring for preventing the orbiting scroll from rotating around its axis; an oil reservoir provided within a vessel; a crankshaft for transmitting a power for compressing a working fluid; and a frame on which a main bearing for supporting the crankshaft is provided, wherein the crankshaft is provided with oil supply passages for communicating a vicinity of an orbiting bearing and a vicinity of the main bearing, and openings of the oil supply passages in the vicinity of the orbiting bearing and in the vicinity of the main bearing are positioned so that a pressure of an oil film in the orbiting bearing opening generated during an operation of the compressor is higher than a pressure of an oil film in the main bearing opening generated during an operation of the compressor.

In other words, it is achieved by utilizing a pressure difference between both bearing portions and discharging the lubricating oil flowing from the orbiting bearing and the main bearing to the compression chamber via the intermediate pressure chamber to the oil reservoir.

DESCRIPTION OF THE EMBODIMENTS

Embodiments in accordance with the present invention will be described hereinafter with reference to the accompanying drawings by exemplifying a motor-driven hermetic scroll compressor for air conditioning.

Figure 1:
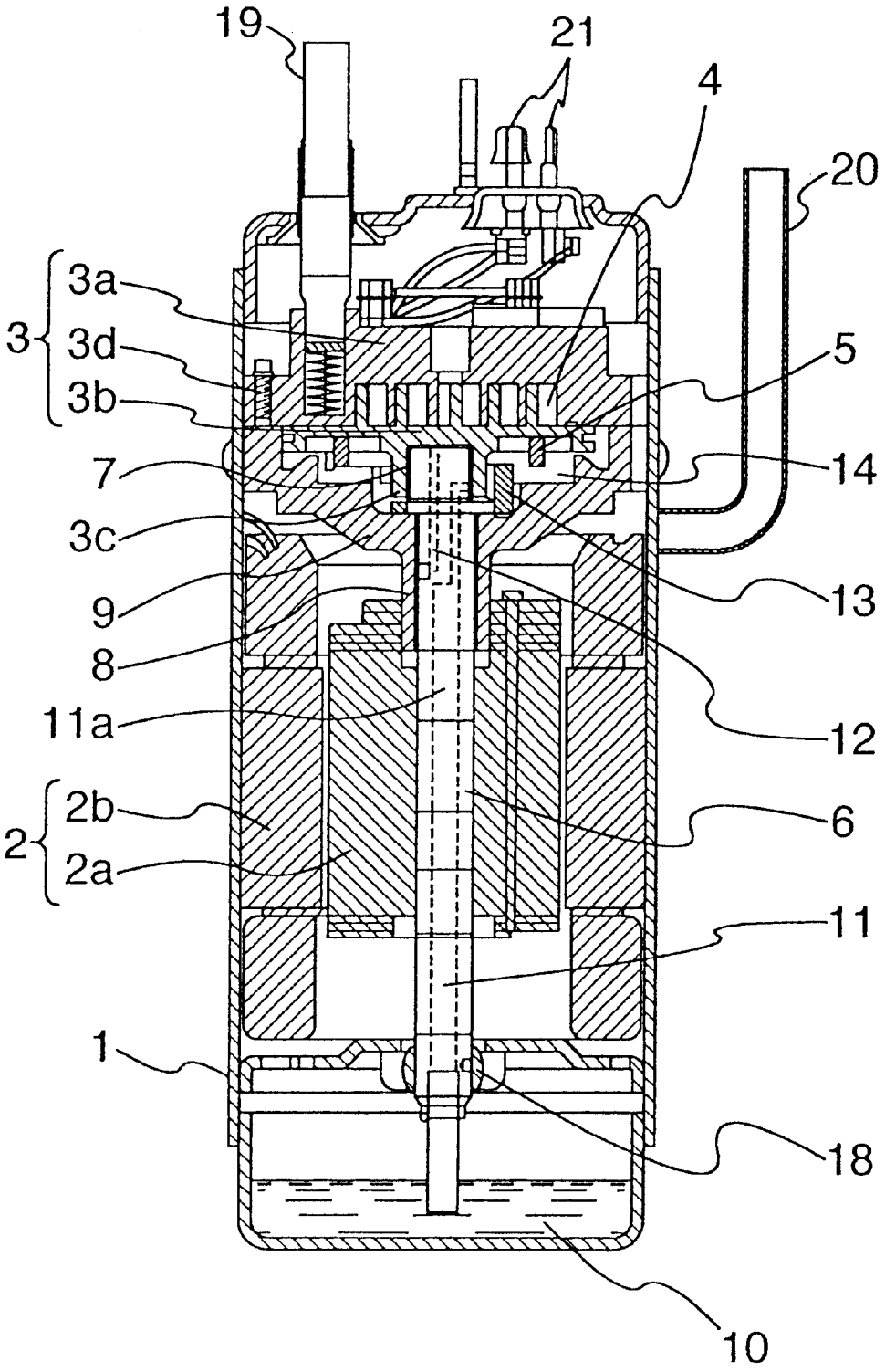
FIG. 1 is a vertical cross sectional view of an embodiment of a scroll compressor in accordance with the present invention.
Figure 2:
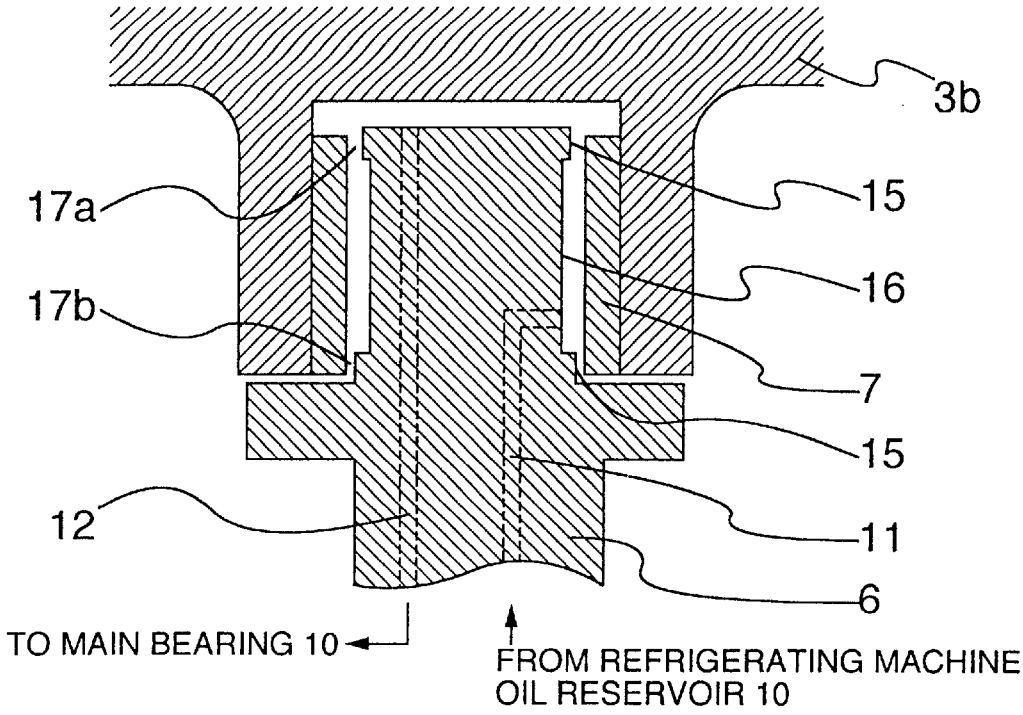
FIG. 2 is an enlarged view of an orbiting bearing portion of the embodiment in FIG. 1.

FIG. 1 is a vertical cross sectional view of an embodiment of a scroll compressor in accordance with the present invention and FIG. 2 is an enlarged view of an orbiting bearing portion.

In FIG. 1, reference numeral 1 denotes a sealed vessel, and an electric motor 2 and a compression mechanism portion 3 connected to the electric motor 2 are received within the vessel 1. The compression mechanism portion 3 comprises a non-orbiting scroll 3*a* and an orbiting scroll 3*b* have spiral wraps on their base plates and form a compression chamber 4 by meshing the respective wraps with each other. Further, the electric motor 2 comprises a rotor 2*a* and a stator 2*b*. Reference numeral 5 denotes an Oldham ring, which is provided for preventing the orbiting scroll 3*b* from rotating around its axis when a crankshaft mentioned below rotates. Reference numeral 6 denotes the crankshaft, which is provided for transmitting a power of rotation of the electric motor 2 to the orbiting scroll 3*b*. Reference numeral 7 denotes an orbiting bearing, which slidably supports the crankshaft 6 and the orbiting scroll 3*b* at a boss portion 3*c* thereof. Reference numeral 8 denotes a main bearing, which slidably supports the crankshaft 6 and a frame 9. The non-orbiting scroll 3*a* is fixed to the frame 9 by means of screws 3*d*.

Reference numeral 10 denotes an refrigerating machine oil reservoir, which is disposed at a bottom portion of the vessel 1 and structured and is communicated with a discharge side of the compression chamber 4 so that the refrigerating machine oil reservoir 10 and the discharge side are made under the same high pressure. Reference numeral 11 denotes a first oil supply passage provided within the crankshaft 6. A lower end opening of the first oil supply passage 11 is immersed in a refrigerating machine oil in the refrigerating machine oil reservoir 10 and an upper end opening thereof is opened to a lower portion of a side surface of the orbiting bearing 7 so as to face to a lower portion of a side surface of the boss portion 3*c* of the orbiting scroll 3*b*. Reference numeral 11*a* denotes a portion of the first oil supply passage 11, which is provided for directly introducing the refrigerating machine oil to the main bearing 8 from the first oil supply passage 11. Reference numeral 12 denotes a second oil supply passage, which is provided in the crankshaft 6. An upper end of the second oil supply passage 12 is opened to an upper surface of the orbiting bearing 7 so as to face to an upper surface of the boss portion 3*c* of the orbiting scroll 3*b*. Further, a lower end of the second oil supply passage 12 is opened to a side surface of the main bearing 8. Reference numeral 13 denotes a balance weight, which is provided within an intermediate pressure chamber 14 formed by the orbiting scroll 3*b* and the frame 9 and mounted on the crankshaft 6.

Reference numeral 15 denotes a throttle, in which as shown in FIG. 2, a recess portion 16 is formed in the crankshaft 6 and an upper clearance 17*a* and a lower clearance 17*b* are respectively formed between upper and lower projections 15 and the orbiting bearing 7. The upper clearance 17*a* is formed so as to be greater than the clearance 17*b*, so that more refrigerating machine oil is flowed from the upper clearance 17*a*. Reference numeral 18 denotes a sub bearing, which supports the crankshaft 6 at a lower portion thereof. Reference numerals 19 and 20 respectively denote a suction pipe for a refrigerant gas and a discharge pipe, which are connected to a refrigerating cycle (not shown). Reference numeral 21 denotes a terminal to a power source.

In particular, during an operation of the scroll compressor, the crankshaft 6 rotates in the orbiting bearing 7 and the main bearing 8 at a position shifted in a direction of a load and a partly small wedge-like space is generated in a clearance between the crankshaft 6 and the orbiting and main bearings 7, 8. When the refrigerating machine oil is caught in the wedge-like space due to its viscosity, the refrigerating machine oil is gradually pressed into the small clearance portion in the wedge-like space, whereby a pressure is generated. On the contrary, a relatively low pressure is generated in a side in which the clearance between the orbiting and main bearings 7, 8 and the crankshaft 6 is large.

Accordingly, the first oil supply passage 11 within the crankshaft 6 is provided at a lower position of the orbiting bearing 7. Further, an opening of the second oil supply passage 12 in a side of the main bearing 8 is provided in a side in which the clearance between the main bearing 8 and the crankshaft 6 is relatively increased, and is positioned at a position at which a pressure of an oil film within the orbiting bearing 7 becomes higher than a pressure within the main bearing 8.

An operation of the scroll compressor having the structure mentioned above will be described hereinafter.

When the orbiting scroll 3*b* is rotated by the motor 2 in accordance with the operation of the scroll compressor, a refrigerant gas in the refrigerating cycle is sucked from the suction pipe 19, and the refrigerant gas is compressed by the compression chamber 4 of the compression mechanism portion 3 constituted by the non-orbiting scroll 3*a* and the orbiting scroll 3*b* to become a compressed refrigerant gas having a higher temperature and a higher pressure than a suction pressure and be discharged from the discharge pipe 20. At this time, a pressure within the refrigerating machine oil reservoir 10 also becomes at a high pressure which is the same as the pressure in the discharge side of the compression chamber 4.

On the other hand, the intermediate pressure chamber 14 is at a pressure substantially middle between the suction pressure and the discharge pressure (hereinafter, refer to an intermediate pressure), and a pressure difference is generated between the discharge pressure, that is, the pressure of the refrigerating machine oil reservoir 10 and the pressure of the intermediate pressure chamber 14, that is, the intermediate pressure (discharge pressure>intermediate pressure). Accordingly, the refrigerating machine oil is sucked from the first oil supply passage 11 in the crankshaft 6 due to the pressure difference between the refrigerating machine oil reservoir 10 and the intermediate pressure chamber 14 to be supplied to the orbiting bearing portion 7. At the same time, the oil supply to the orbiting bearing 7 is also performed by an action of a centrifugal force due to the rotation of the crankshaft 6.

The refrigerating machine oil supplied to the orbiting bearing 7 further flows to the main bearing 8 via the second oil supply passage 12 due to a forcible oil supply to the orbiting bearing 7. The refrigerating machine oil having flowed into the main bearing 8 is again returned to the refrigerating machine oil reservoir 10, so that a circulating flow is formed.

As mentioned above, by making the upper clearance 17*a* greater than the lower clearance 17*b*, it is possible to make a lot of refrigerating machine oil to flow to the main bearing 8 from the upper clearance 17*a*. On the other hand, since making an amount of the refrigerating machine oil flowing to the compression chamber 4 from the lower clearance 17*b* via the intermediate pressure chamber 14 a little by throttling the lower clearance 17*b*, the supplied amount of the refrigerating machine oil to the orbiting bearing 7 and the main bearing 8 is increased, so that a lubrication is well performed and a reliability is improved. Further, since the flow amount to the intermediate pressure chamber 14 is reduced, a power used for the balance weight 13 agitating the refrigerating machine oil is reduced, so that it is possible to reduce an electric power consumption.

Further, an amount of the refrigerant gas generated in the intermediate pressure chamber 14 which is generated by the balance weight 13 agitating the refrigerating machine oil and an amount of the refrigerant gas generated from the refrigerating machine oil flowing to the compression chamber 4 are reduced. Accordingly, an amount of the refrigerant gas sucked by the compression chamber 4 from the suction pipe 19 is also increased, and therefore, an amount of the circulating refrigerant in the refrigerating cycle is increased.

In accordance with the present embodiment of the invention, there can be obtained advantages that since the flow amount to the intermediate pressure chamber is reduced, a power used for the balance weight agitating the refrigerating machine oil is reduced, so that an electric power consumption is reduced, and since an amount of the refrigerant gas sucked by the compression chamber from the suction pipe is also increased, an amount of the circulating refrigerant in the refrigerating cycle is increased. Further, a lubrication for the orbiting and main bearings is well performed, and a reliability of the bearings is improved.

Figure 3:
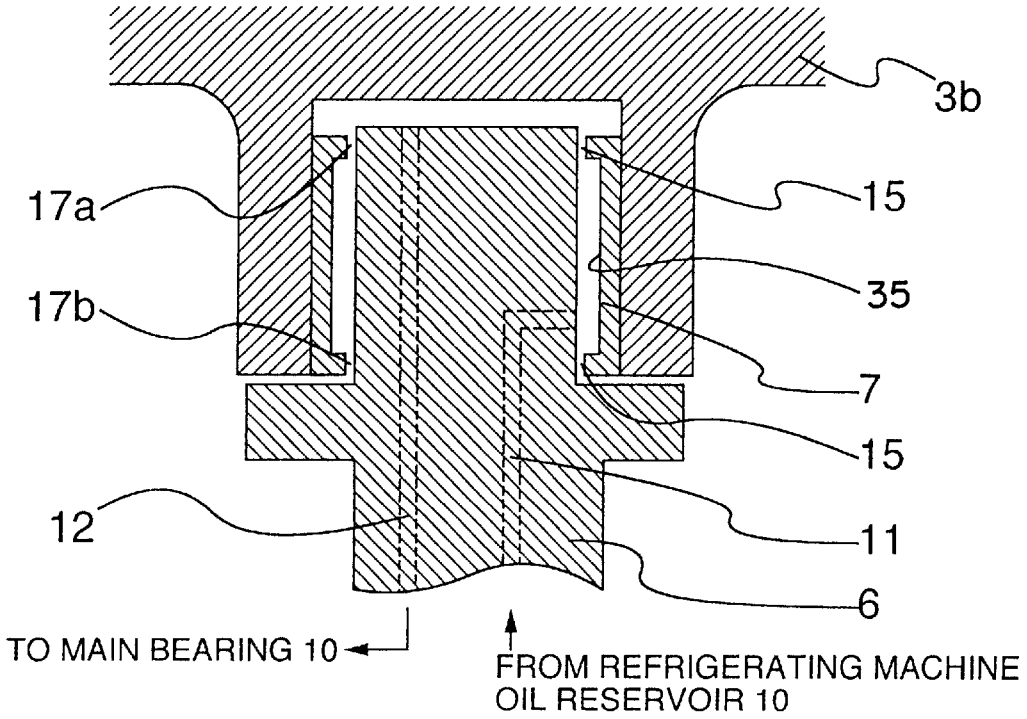
FIG. 3 is an enlarged view of another embodiment of the orbiting bearing portion.

Another embodiment in connection with the throttle is shown in FIG. 3. In this embodiment, a recess portion 18 is formed in the orbiting bearing 7. Here, similar to the embodiment shown in FIG. 1, the clearance 17*a* is formed to be greater than the clearance 17*b*.

In accordance with the present embodiment, the same advantages as those of the embodiment shown in FIG. 1 can be obtained.

Figure 4:
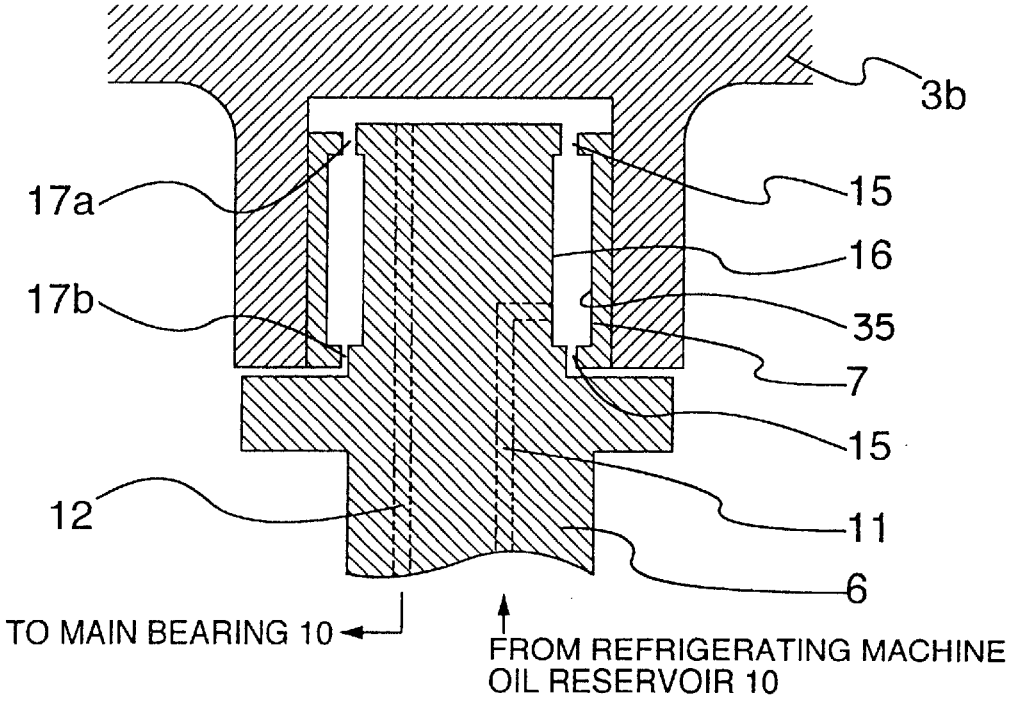
FIG. 4 is an enlarged view of the other embodiment of the orbiting bearing portion.

The other embodiment in connection with the throttle will is shown in FIG. 4. In this embodiment, recess portions 16 and 18 are formed in the crankshaft 6 and the orbiting bearing 7. Here, similar to the embodiment shown in FIG. 1, the clearance 17*a* is formed to be greater than the clearance 17*b*.

In accordance with the present embodiment, the same advantages as those of the embodiment shown in FIG. 1 can be obtained.

Figure 5:
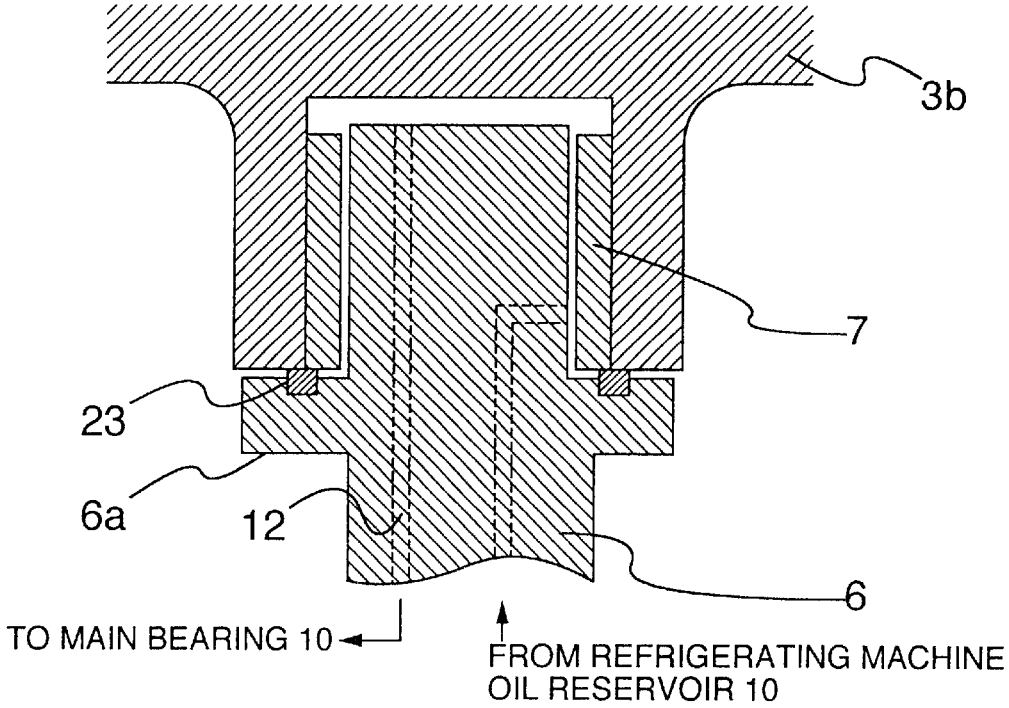
FIG. 5 is an enlarged view of still other embodiment of the orbiting bearing portion.

Still other embodiment in connection with the throttle is shown in FIG. 5. In this embodiment, a seal 23 is interposed between an upper end surface of a flange 6*a* in the crankshaft 6 and lower end surfaces of the orbiting scroll 3*b* and the orbiting bearing 7. A clearance of this portion is made to be smaller than a clearance between the crankshaft 6 and the orbiting bearing 7 so that the refrigerating machine oil flows more in an upper direction in the drawing to be guided to the second oil supply passage 12.

The clearances mentioned above are not limited in view of a size relation since it is sufficient to control a target flow amount of the oil, however, in general, they have a tendency to satisfy the relation upper clearance≧lower clearance.

In accordance with this embodiment, the same advantages as those of the embodiment shown in FIG. 1 can be obtained.

Figure 6:
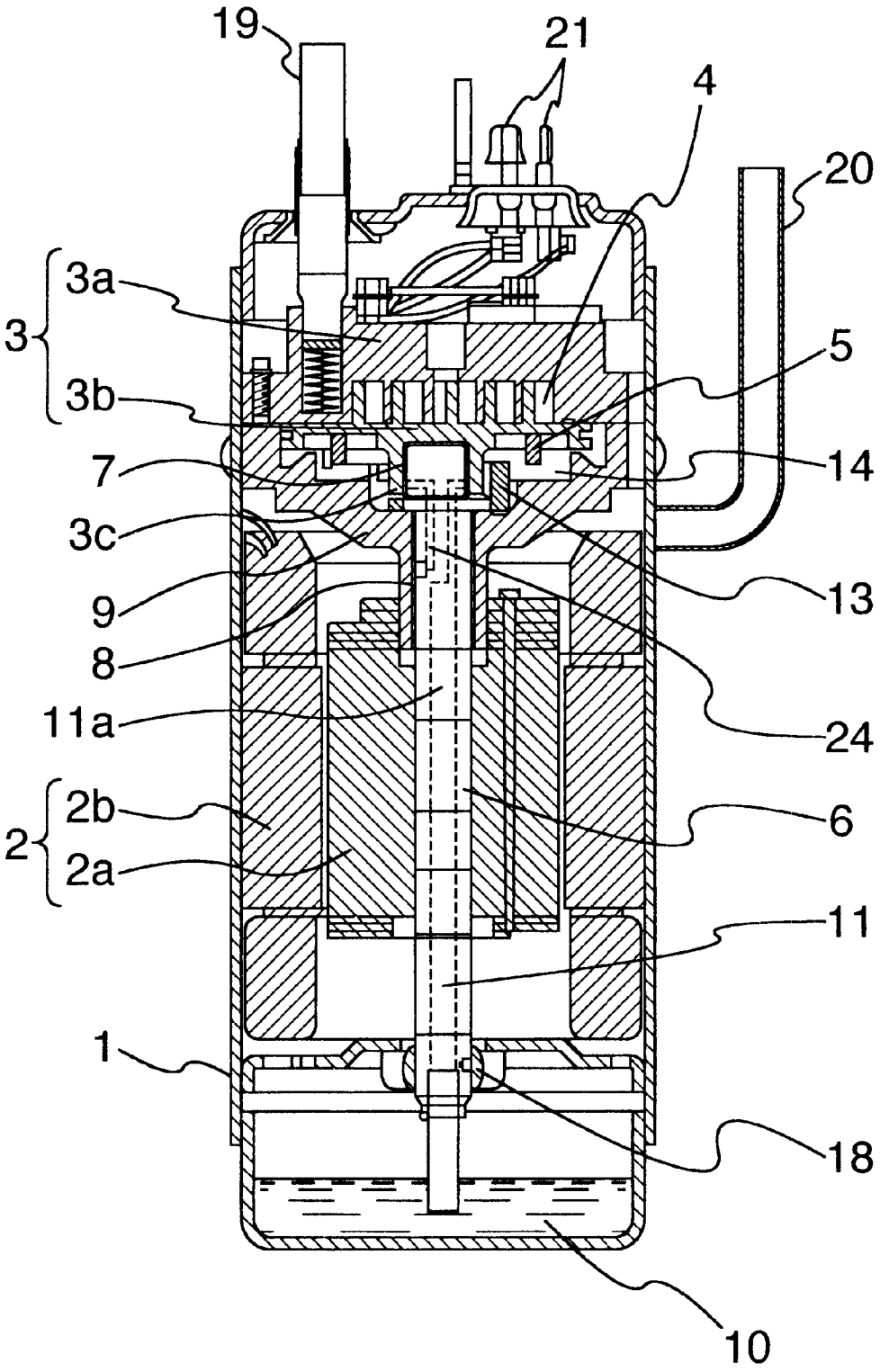
FIG. 6 is a vertical cross sectional view of another embodiment of the scroll compressor in accordance with the present invention.

FIG. 6 is a vertical cross sectional view of another embodiment of a scroll compressor in accordance with the present invention.

The present embodiment differs from the embodiment shown in FIG. 1 in that the upper end opening of the first oil supply passage 11 is opened to an upper portion of a side surface of the orbiting bearing 7. Further, an upper end of a second oil supply passage 24 communicating with the main bearing 8 is opened to the side surface of the orbiting bearing 7 and the lower end thereof is opened to the main bearing 8.

In accordance with this embodiment, the same advantages as those of the embodiment shown in FIG. 1 can be obtained.

Figure 7:
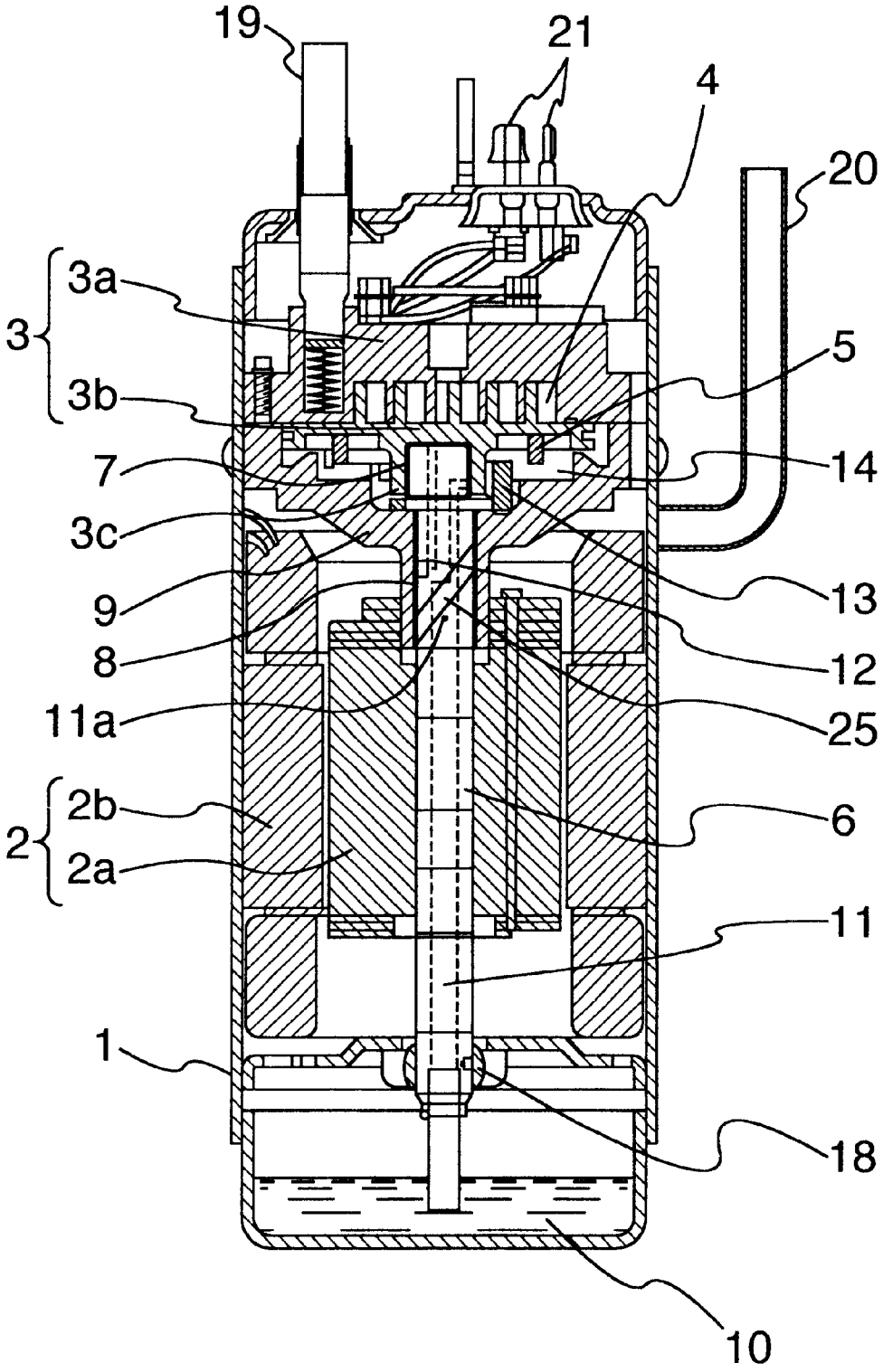
FIG. 7 is a vertical cross sectional view of the other embodiment of the scroll compressor in accordance with the present invention.

FIG. 7 is a vertical cross sectional view of the other embodiment of a scroll compressor in accordance with the present invention.

This embodiment is intended to discharge the refrigerating machine oil from the main shaft 8 by positively discharging the refrigerating machine oil from the lower end of the main bearing 8 in accordance with a pressure of an oil film between the main bearing 8 and the crankshaft 6. The present embodiment is different from the embodiment shown in FIG. 1 in that recessed spiral grooves 25 are formed on the crankshaft 6. Due to the spiral grooves 25, the refrigerating machine oil is discharged from the lower end of the main bearing 8 to the refrigerating machine oil reservoir 10 having a higher pressure. In this case, the spiral grooves 25 may be formed in the main bearing 8.

In accordance with the present embodiment, due to a viscosity of the refrigerating machine oil and a pumping action of the spiral grooves, it is possible to better discharge the refrigerating oil from the main bearing 8 to the refrigerating machine oil reservoir, and a reliability of the bearings is improved.

Figure 8:
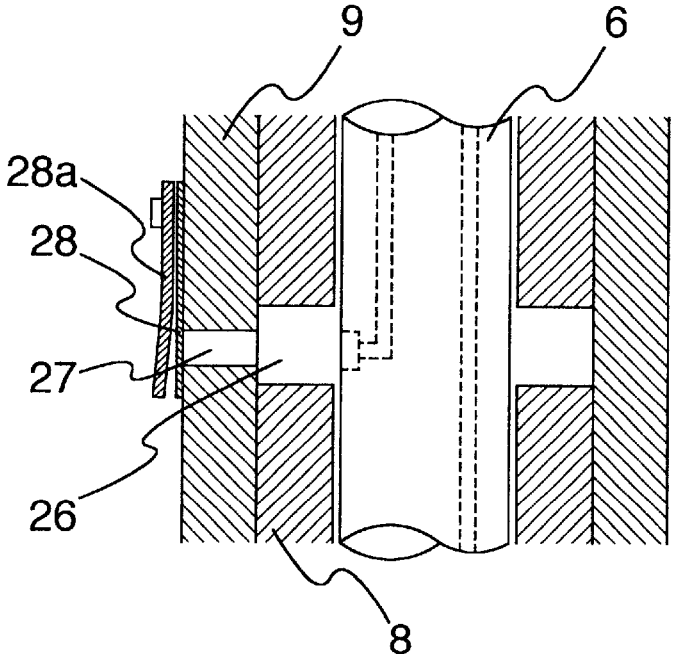
FIG. 8 is an enlarged view of an embodiment of a main bearing portion.

Further, FIG. 8 is a vertical cross sectional view of a further embodiment of a scroll compressor in accordance with the present invention. The present embodiment also corresponds to an embodiment in which the refrigerating machine oil is positively discharged. It is different from the embodiment shown in FIG. 7 in that discharge holes 26, 27 for the refrigerating machine oil are respectively provided in the main bearing 8 and the frame 9, and a plate-like valve 28 and a retainer 28*a* for limiting an opening movement of the valve 28 are provided for preventing the refrigerant gas from flowing backward. The present embodiment is structured such that a pressure within the main bearing 8 is increased due to a rotation of the crankshaft 6, thereby discharging the refrigerating machine oil from the discharge holes 26, 27. Since openings of the discharge holes 26, 27 are in the refrigerant gas in the refrigerating machine oil reservoir 10, the reverse flow of the refrigerant gas can be prevented even in the case that a pressure increase within the main bearing 8 is insufficient.

Figure 9:
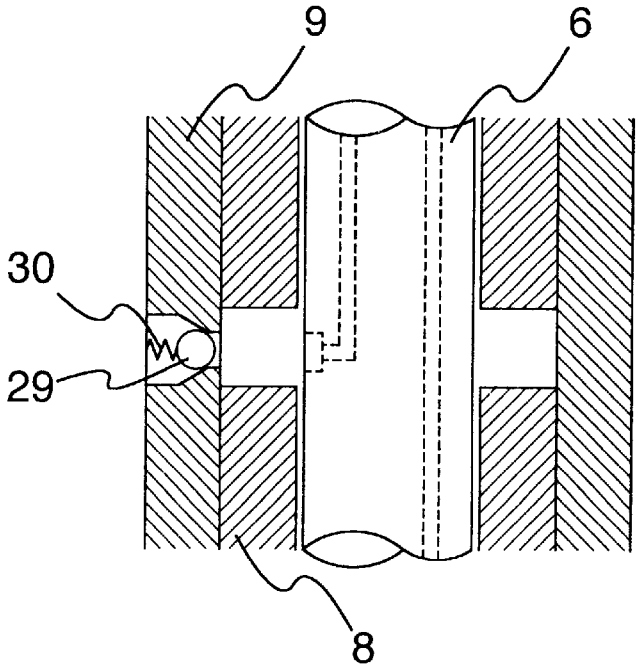
FIG. 9 is an enlarged view of another embodiment of the main bearing portion.

Further, as means for preventing a reverse flow, as shown in FIG. 9, a structure may be constituted by a ball valve 29 and a spring 30 for biasing the ball valve 29.

In accordance with this embodiment, it is possible to more effectively discharge the refrigerating machine oil from the main bearing to the refrigerating machine oil reservoir.

Figure 10:
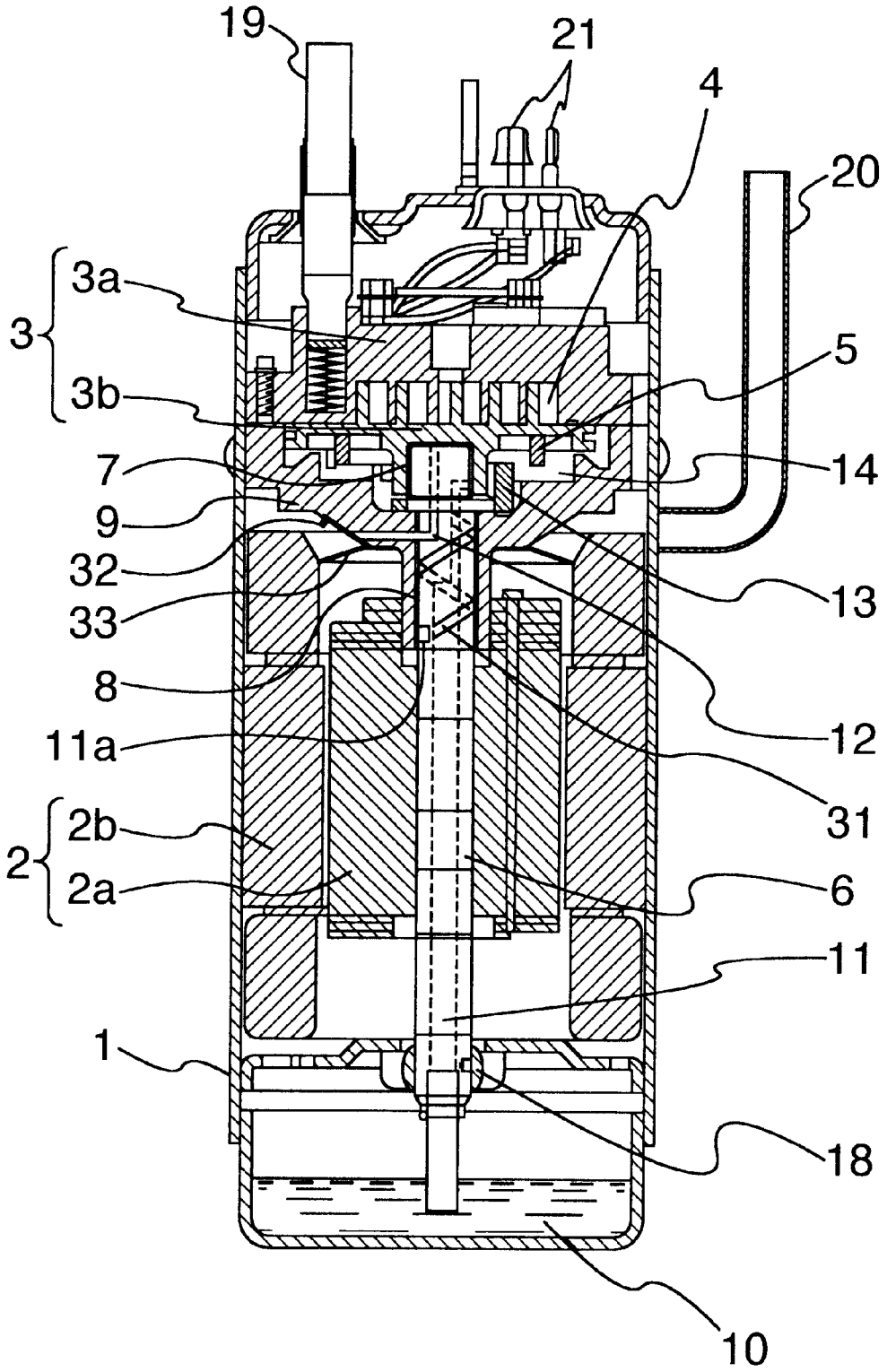
FIG. 10 is a vertical cross sectional view of the other embodiment of the scroll compressor in accordance with the present invention.

FIG. 10 is a vertical cross sectional view of further other embodiment of a scroll compressor in accordance with the present invention. The present embodiment also corresponds to an embodiment in the case of intending to positively discharge the refrigerating machine oil. It is different from the embodiment shown in FIG. 7 in that a spiral groove pump 31 for performing a pumping action is provided in the crankshaft 6. The refrigerating machine oil supplied to the lower portion of the main bearing 8 is fed to the upper end opening of the second oil supply passage 12 by the spiral pump 31 so as to reduce an amount of the refrigerating machine oil discharged from the lower end of the main bearing 8. Further, the structure is made such that a plate valve 32 for preventing the refrigerant gas from flowing backward is provided in the portion of the frame 9 to which the second oil supply passage 12 is opened and an oil cover 33 is provided below the valve 32, thereby preventing the refrigerating machine oil discharged from the second oil supply passage 12 from directly scattering to the rotor 2*a* and forming a mist.

In accordance with the present embodiment, in addition to the advantages of the embodiment shown in FIG. 8 or FIG. 9, since the refrigerating machine oil is not brought into contact with the rotor 2*a*, there are advantages that the refrigerating machine oil does not form a mist and can be prevented from flowing into the refrigerating cycle.

Figure 11:
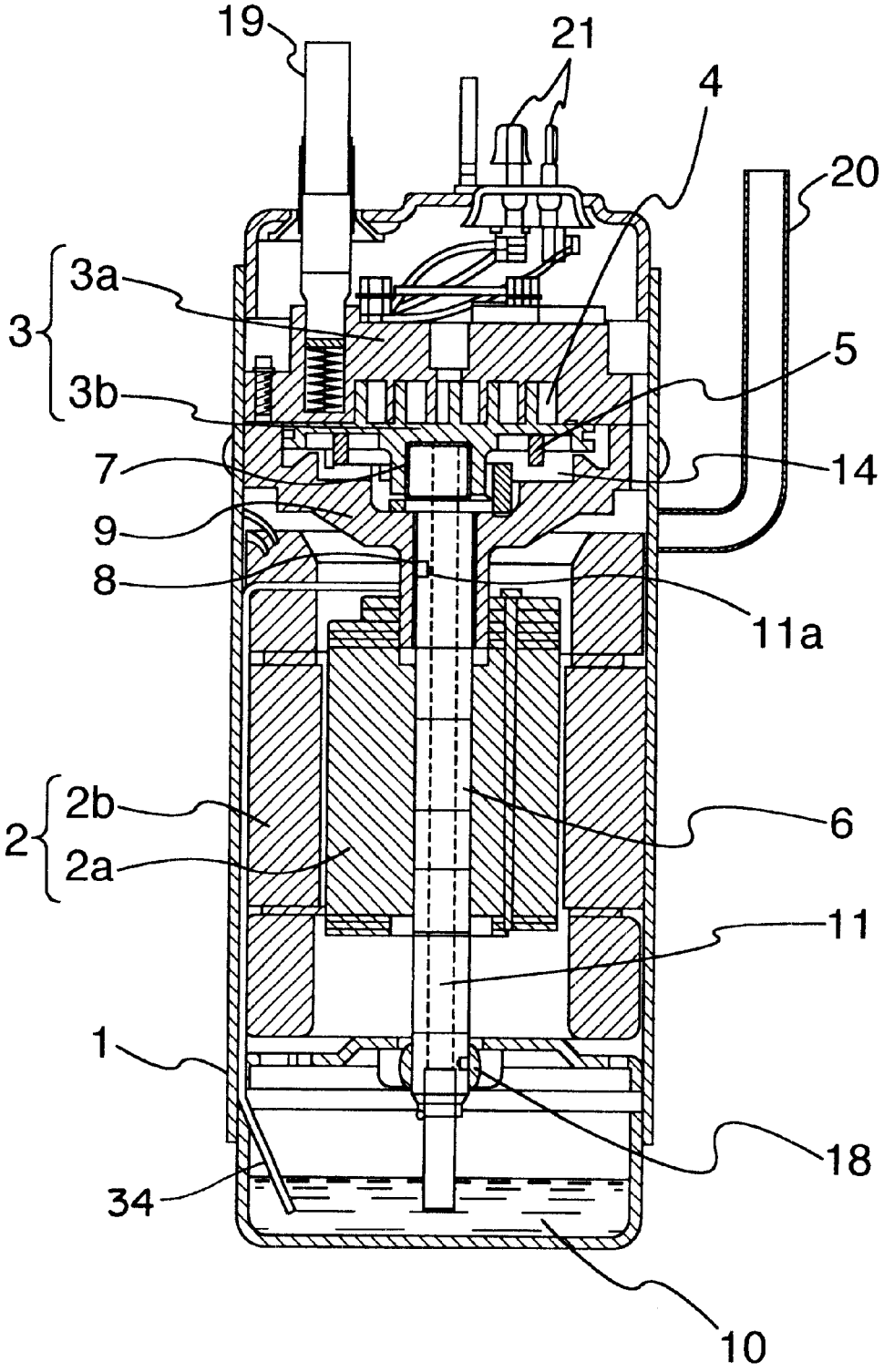
FIG. 11 is a vertical cross sectional view of still other embodiment of the scroll compressor in accordance with the present invention.

FIG. 11 is a vertical cross sectional view of still other embodiment of a scroll compressor in accordance with the present invention. The present embodiment also corresponds to an embodiment in the case of positively discharging the refrigerating machine oil, and is different from the embodiment shown in FIG. 10 in that a discharge pipe 34 is provided for discharging the refrigerating machine oil from the frame 9 to the refrigerating machine oil reservoir 10.

Particularly, even in the case that the pressure within the main bearing 8 becomes lower than the refrigerating machine oil reservoir 10 at a time of starting of the compressor, it is possible to introduce the refrigerating machine oil into the main bearing 8 from the orbiting bearing 7 in accordance with a pressure difference by arranging one end of the discharge pipe so as to be always under the oil in refrigerating machine oil reservoir 10.

The above-described embodiments are ones in which the scroll compressor is applied to the refrigerating cycle. The present invention, however, may be employed to a compressor for compressing a gas such as an air, a helium and the like having a low compatibility with an oil and a compressor which employs a semi-sealed vessel represented by a car air conditioner.

In accordance with the present invention, since a flow amount to the intermediate pressure chamber is reduced, a power used for the balance weight agitating the refrigerating machine oil is reduced, so that an electric power consumption is reduced, and since an amount of the refrigerant gas sucked by the compression chamber from the suction pipe is also increased, an amount of the circulating refrigerant in the refrigerating cycle is increased, thereby improving a performance.

Further, a lubrication for the orbiting bearing and the main bearing is well performed, and a reliability of the bearings is improved.

What is claimed is:

1. A scroll compressor comprising:

a vessel;

a compressing mechanism provided within said vessel, the compressing mechanism comprising an orbiting scroll and a non-orbiting scroll each having a spiral wrap formed in a base plate and an Oldham ring for preventing the orbiting scroll from rotating around its axis;

an oil reservoir provided within a vessel;

a crankshaft for transmitting a power for compressing a working fluid; and a frame on which a main bearing for supporting the crankshaft is provided, wherein the crankshaft is provided with a first oil supply passage communicating between the oil reservoir and an orbiting bearing for the crankshaft to feed lubricating oil to the orbiting bearing, and a second oil supply passage communicating between the orbiting bearing and the main bearing for the crankshaft to feed lubricating oil from the orbiting bearing to the main bearing.

2. A scroll compressor as claimed in claim 1, further comprising means for discharging lubricating oil from said main bearing portion to the oil reservoir within the vessel.

3. A scroll compressor as claimed in claim 2, wherein means for preventing occurrence of reverse flow of the oil is provided in a lubricating oil flow passage communicating said main bearing and said frame with the lubricating oil reservoir.

4. A scroll compressor as claimed in claim 2, wherein a discharge hole is provided in said main bearing and said frame, and a discharge pipe is connected to the discharge hole at one end thereof and is opened to said lubricating oil reservoir at the other end thereof, the other end being immersed into the lubricating oil in the lubricating oil reservoir.

5. A scroll compressor as claimed in claim 2, further comprising a flow passage by which the lubricating oil discharged from said main bearing and said frame is introduced into the lubricating oil reservoir without attaching to the rotor.

* * * * *

UNITED STATES PATENT AND TRADEMARK OFFICE

CERTIFICATE OF CORRECTION

PATENT NO. : 6,494,696 B2
DATED : December 17, 2002
INVENTOR(S) : Terai et al.

It is certified that error appears in the above-identified patent and that said Letters Patent is hereby corrected as shown below:

Title page,
Insert: Item -- [30] Foreign Application Priority Data
Dec. 14, 1998 (JP) …. 10-354909 --

Signed and Sealed this

Twentieth Day of May, 2003

JAMES E. ROGAN
*Director of the United States Patent and Trademark Office*